United States Patent [19]

Murawski

[11] 4,155,308

[45] May 22, 1979

[54] SABOT FOR SIMULATION TESTING

[75] Inventor: Paul M. Murawski, Blue Island, Ill.

[73] Assignee: The United States of America as represented by the Secretary of the Air Force, Washington, D.C.

[21] Appl. No.: 847,952

[22] Filed: Nov. 2, 1977

[51] Int. Cl.[2] ..... F42B 13/16

[52] U.S. Cl. ..... 102/93

[58] Field of Search ..... 102/93, DIG. 7

[56] References Cited

U.S. PATENT DOCUMENTS 4,083,306 4/1978 Woodring ..... 102/DIG. 7

FOREIGN PATENT DOCUMENTS 1262830 3/1968 Fed. Rep. of Germany ..... 102/93

*Primary Examiner*—Verlin R. Pendegrass

*Attorney, Agent, or Firm*—Joseph E. Rusz; Richard J. Killoren

[57] ABSTRACT

A sabot, having four quadrant sections, for use in testing of impact damage of metal fragment-type products. The quadrant sections include molded alignment guides and a depression which forms a central cavity for holding payloads. Recesses are provided in the quarter sections to reduce weight. An external gas plug flare is provided on the external surface of the sabot. The sabot has a conical recess at the forward end with a hole into the interior of the sabot to enhance separation of the quadrant sections after the sabot has left the gun barrel.

1 Claim, 11 Drawing Figures

SABOT FOR SIMULATION TESTING

RIGHTS OF THE GOVERNMENT

The invention described herein may be manufactured and used by or for the Government of the United States for all governmental purposes without the payment of any royalty.

BACKGROUND OF THE INVENTION

This invention relates to sabots used in the firing of projectiles from smooth-bore gun barrels.

The patents to Aherns, U.S. Pat. No. 620,400; Manning et al, U.S. Pat. No. 3,427,648; Romer et al, U.S. Pat. No. 3,620,167, and Jaslow, U.S. Pat. No. 3,665,861, show various cage devices for various projectiles.

In the testing of impact damage to certain products, such as aircraft fuel system components, it is desirable to obtain test results without the use of actual high explosive warheads. The system used must be capable of withstanding velocities up to 2130 meters per second without experiencing material breakdown which would be detrimental to performance and reliability. The system used should provide spread behavior which is predictable and repetitive.

BRIEF SUMMARY OF THE INVENTION

According to this invention, sabots are made of four identical quadrant sections. The sabots made of the quadrant sections have internal cavities designed to handle a variety of payload configurations. Molded alignment guides are provided to guarantee stability while the sabots are in the gun barrel and during launch. The forward end of the sabots are shaped as a recessed cone with a hole into the interior of the sabots at the apex of the cone to enhance separation and spread capabilities of the sabots. Recesses are provided in the sabot quarter sections to reduce weight and enhance separation. An outward flair is provided on the external surface of the quadrant sections to provide a gas plug during travel of the sabot down the gun barrel.

IN THE DRAWINGS

DETAILED DESCRIPTION OF THE INVENTION

Figure 1:
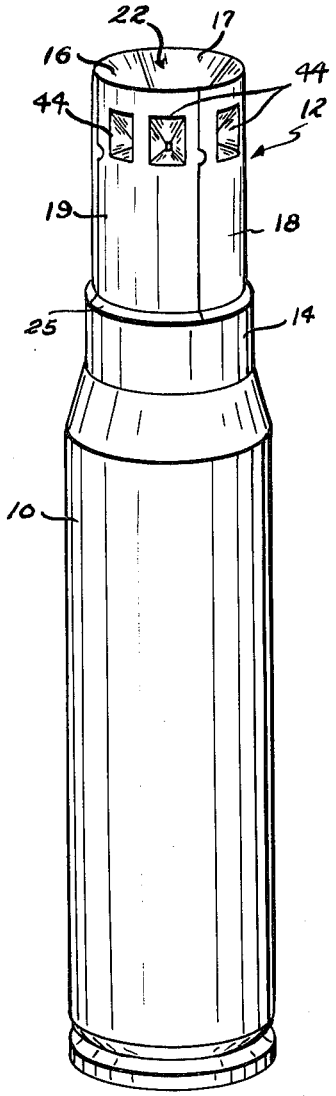
FIG. 1 is an isometric view of a cartridge shell together with a sabot according to the invention.

Reference is now made to FIG. 1 of the drawing, which shows a 30 MM cartridge 10 and a sabot 12 positioned within the neck 14 of cartridge 10.

The sabot is made up of four identical molded quadrant sections 16, 17, 18 and 19. The quadrant sections are made of a durable plastic material. The sabots constructed were made of LEXAN-141.

Figure 2:
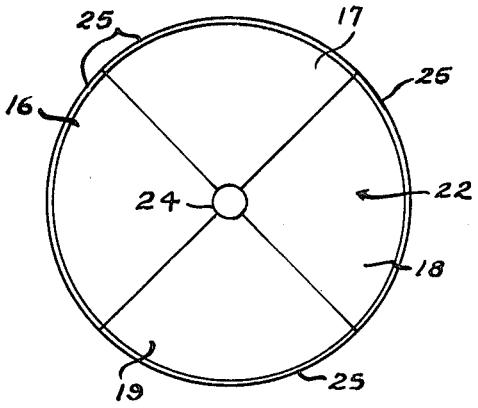
FIG. 2 is a top view of the sabot in the device of FIG. 1.
Figure 5:
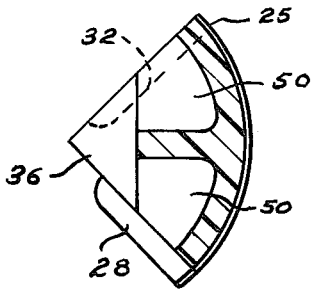
FIG. 5 is a sectional view of the device of FIG. 4 along the line 5—5.

The forward end of the quadrant sections are shaped to form a recessed conical cavity 22 at the forward end of the sabot. This conical cavity, together with a hole 24 leading into the interior of the sabot, shown in FIG. 2, acts to enhance separation and spread capabilities of the sabot. An external flare projection 25 is provided on the surface of the quadrant sections to provide a gas plug to prevent escape of the propulsion gas during launch.

Each quadrant section, shown in greater detail in FIGS. 3–8, includes two molded alignment projections 26 and 28 and two similarly shaped indentations 30 and 32. The projection 28 and identation 30 mate with corresponding projections 26 and indentations 32 on adjoining quadrant sections to provide stability of the sabot while the sabot is in the gun barrel during launch.

Figure 6:
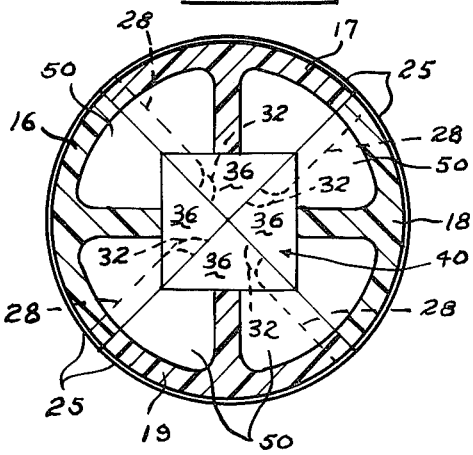
FIG. 6 is a sectional view corresponding to FIG. 5 of the four quadrant sections of the sabot of FIGS. 1 and 2.
Figure 7:
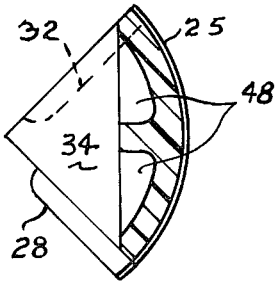
FIG. 7 is a sectional view of the device of FIG. 4 along the line 7—7.
Figure 3:
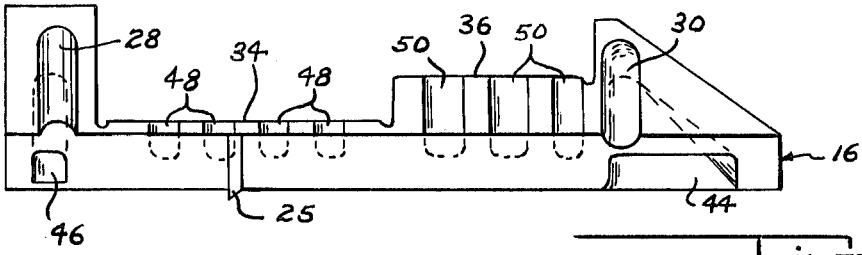
FIG. 3 is a side view of one of the quarter sections of the sabot of FIGS. 1 and 2.
Figure 4:
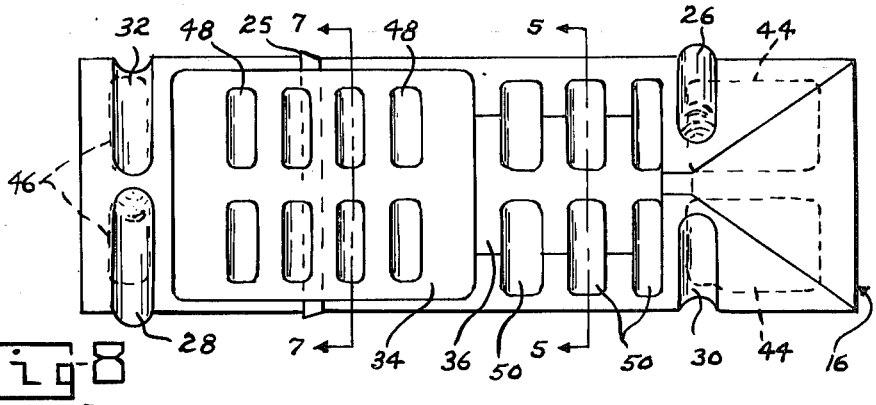
FIG. 4 is a top view of the device of FIG. 3.
Figure 8:
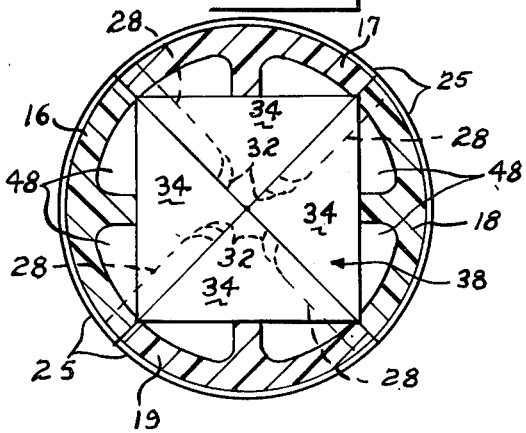
FIG. 8 is a sectional view corresponding to FIG. 7 of the four quadrant sections of the sabot of FIGS. 1 and 2.

The quadrant sections have recessed portions 34 and 36 which conform with similar recessed portions in the other sections to form rectangular interior cavities 38 and 40 as shown in FIGS. 6 and 8 to accommodate a variety of payload configurations, for example, different arrangements of 10 grain to 240 grain cubical steel fragments.

Cavities 44, 46, 48 and 50 are provided in the sabot quarter sections to reduce the weight of the sabot to enhance separation of the sabot quadrant sections after launch.

In the operation of the device, the desired payload is placed in the indentations 38 and 40 and the projections 26 and 28 of the four quadrant sections are made to engage corresponding indentations 30 and 32 on adjacent quadrant sections. The complete sabot is fitted into the neck portion 14 of a cartridge 10 as shown in FIG. 1.

Upon launch, the projections 25 provide a seal to prevent escape of the launch gases until the sabot clears the gun barrel. The projections 26 and 28 engage indentations 30 and 32 and maintain stability of the sabot while the sabot is in the gun barrel.

When the sabot leaves the gun barrel, air entering the conical cavity 22 and hole 24 forces separation of the quadrant sections and permit the payload to proceed to the target. In a device tested, separation of the quadrant sections was achieved with a spray diameter of 10 cm within 30 cm of the end of the gun barrel. The sabot spread behavior was repetitive and predictable. In the tests conducted a collector plate, with a hole to permit passage of the payload to the target, was placed between the gun barrel and the target to collect the sabot quadrant sections so that only the payload would proceed to the target.

With this device, desired payload fragment spread, concentration, orientation on the target and velocity information are easily derived with repetitive results.

Figure 9:
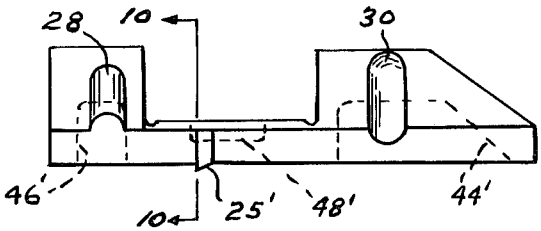
FIG. 9 is a side view of a quarter section of a sabot according to another embodiment of the invention.
Figure 10:
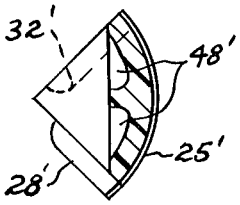
FIG. 10 is a sectional view of the device of FIG. 9 along the line 10—10.
Figure 11:
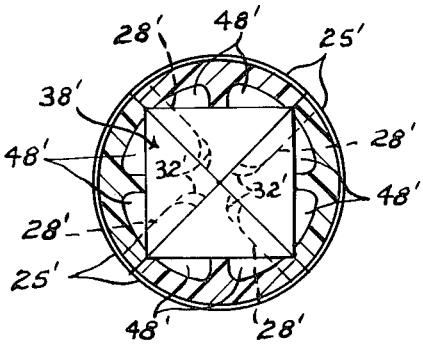
FIG. 11 is a sectional view corresponding to FIG. 10 of a sabot with four quadrant sections modified according to FIG. 9.

While the device thus far described relates to sabots for use with a 30 MM cartridge, a modified sabot, designed for use with a 20 MM cartridge, shown in FIGS. 9–11, was also constructed.

The device of FIGS. 9–11 has alignment projections 26', not shown, and 28' and indentations 30' and 32' similar to projections 26 and 28 and indentations 30 and 32 in FIGS. 5–8. A forward conical indentation and hole, not shown, similar to conical cavity 22 and hole 24, is also provided in the device of FIGS. 9–11. A flare projection 25' is provided as in the device of FIGS. 1–8. Weight reducing cavites 44', 46' and 48' are also provided as in the device of FIGS. 1–8. The device of FIGS. 9–11 differs from the device of FIGS. 1–8 essentially in size and with the provision of one central cavity 38' instead of the two cavities 38 and 40 in FIGS. 1–8. The operation of the device of FIGS. 9–11 is substantially the same as the device of FIGS. 1–8.

There is thus provided a sabot for use in impact damage tests of products which provides easily derived repetitive results.

I claim:

1. A sabot for firing projectiles from smooth-bore gun barrels, comprising: four identical quadrant sections with each quadrant section including a depression adapted to form a central cavity together with the other quadrant sections wherein the central cavity is adapted for holding payloads; means on each quadrant section for aligning each quadrant section with adjacent quadrant sections; each of the quadrant sections having a portion of a conical surface, adapted to fit with corresponding conical surfaces of the other quadrant sections to form a conical recess at the forward end of the sabot; said quadrant sections including means for cooperating with the other quadrant sections to form a hole into the interior of the sabot; said quadrant sections including means, on the external surface, for preventing escape of propulsion gas past the sabot during launch; said depression in each quadrant section being shaped to form different size cavities in different portions of the sabot; a plurality of weight reducing depressions in each quadrant section; said aligning means including a plurality of projections and a plurality of grooves wherein the projections and grooves on each quadrant section are adapted to engage corresponding grooves and projections on adjacent quadrant sections.

* * * * *